US006227314B1

(12) United States Patent
Zadrapa et al.

(10) Patent No.: US 6,227,314 B1
(45) Date of Patent: May 8, 2001

(54) INCLINED LEG EARTH-BORING BIT

(75) Inventors: Glenn R. Zadrapa, Highlands; Gregory L. Ricks; Kenneth C. Brannon, both of The Woodlands; Robert E. Grimes, Houston; Kevin W. Schader, Spring, all of TX (US)

(73) Assignee: Baker Hughes, Inc., Houston, TX (US)

( * ) Notice: Subject to any disclaimer, the term of this patent is extended or adjusted under 35 U.S.C. 154(b) by 0 days.

(21) Appl. No.: 09/301,750

(22) Filed: Apr. 29, 1999

(51) Int. Cl.[7] ..... E21B 10/16
(52) U.S. Cl. ..... 175/331; 175/339; 175/353
(58) Field of Search ..... 175/339, 340, 175/350, 353, 393, 331

(56) References Cited

U.S. PATENT DOCUMENTS

| | | | | |
|---|---|---|---|---|
| Re. 32,495 | | 9/1987 | Coates . | |
| 2,885,186 | | 5/1959 | Hammer | 255/314 |
| 4,558,754 | * | 12/1985 | Childers et al. | 175/340 |
| 5,289,889 | | 3/1994 | Gearhart et al. | 175/325.5 |
| 5,415,243 | * | 5/1995 | Lyon et al. | 175/331 |
| 5,586,612 | | 12/1996 | Isbell et al. | 175/353 |
| 5,755,297 | * | 5/1998 | Young et al. | 175/339 |
| 5,791,423 | | 8/1998 | Overstreet et al. | 175/375 |

OTHER PUBLICATIONS

Hughes Christensen HydraBoss; Hydraulically Enhanced Drill Bits; 1997.
U.S. application No. 08/690,887 filed Sep. 20, 1997, Pessier et al.

* cited by examiner

*Primary Examiner*—William Neuder
(74) *Attorney, Agent, or Firm*—Bracewell & Patterson L.L.P.; James E. Bradley

(57) ABSTRACT

An earth-boring bit has a body with a threaded pin on the upper end for connecting to a drill string. Bit legs are formed symmetrically on the exterior of the body and extend downward. The lower portion of each bit leg is inclined and offset circumferentially from the upper portion. A cutter is mounted to the lower portion of each bit leg for rotation about a cutter axis. Nozzle bosses are located between each bit leg. A flow channel exists on both sides of each nozzle boss. The nozzle boss is inclined in a similar direction to the bit leg.

19 Claims, 3 Drawing Sheets

INCLINED LEG EARTH-BORING BIT

TECHNICAL FIELD

This invention relates in general to earth-boring bits and in particular to earth-boring bits with six-point stabilization to resist lateral vibration.

BACKGROUND ART

One type of earth-boring bit has a body with three legs formed on it. A cutter is rotatably mounted to each of the legs, the cutter having teeth or hard-metal inserts. Drilling fluid is pumped down the drill string and discharged out three nozzles. Each nozzle is located between two of the bit legs. The nozzles are housed in a nozzle boss which is a cylindrical protruding portion on a curvilinear exterior surface of the bit body. The drilling fluid strikes the bottom and returns back up channels adjacent each side of each of the nozzle bosses. The bit will contact the borehole wall at three points, each of the points being on the heel row of each of the cutters. The point of contact is on a leading portion of each cutter. Under certain circumstances, a bit may experience rapid lateral displacements, such as when drilling in an oversized hole, during horizontal drilling, within dog legs, or within key seats. These lateral displacements cause disruptions from desired rotation about the geometric centerline of the bit, which is the intended rotational axis. Lateral displacements can cause accelerated wear and catastrophic failure of the cutting elements. Wear resistant inserts have been employed on the upper portions of the bit legs to resist lateral vibration. In this prior art type, the centerline of the wear resistant insert pattern is generally directly above the rotational axis of each cutter. While such wear resistant inserts are beneficial, they do not adequately arrest severe lateral vibration.

Another prior art bit has a stabilizing area containing wear resistant inserts between each of the bit legs. Each stabilizing portion or pad encloses one of the nozzles, replacing the protruding nozzle boss used in other types of bits. The centerline of each stabilizing pad is diametrically opposed to the borehole wall contact point of one of the cutters. The stabilizing pads add three more stabilizing points offset circumferentially or rotationally from the stabilizing points on the cutters. This six-point contact adds more lateral stability to the bit than the prior three-point contact bits. However, the relatively large stabilizing pad on each bit leg tends to reduce the return flow area for drilling fluid and cuttings on smaller diameter bits more than it does on larger diameter bits, where this type of stabilizing pad is successfully used in many commercial applications.

SUMMARY OF INVENTION

In the bit of this invention, each of the bit legs has an upper portion protruding radially from the bit body and a lower portion extending below the bit body. The lower portion of each bit leg is offset circumferentially from the upper portion. The lower portion is inclined so as to position the cutter borehole contact point in a leading direction relative to the upper portion of the bit leg. The upper portion of the bit leg has low friction wear-resistant elements which are preferably slightly under the gage diameter, providing stabilizing areas. The centerline of each stabilizing area is approximately diametrically opposed to the borehole contact point of one of the cutters. The additional stabilizing areas result in six-point borehole contact to resist lateral vibration during drilling.

A nozzle boss is located between each of the bit legs. Each nozzle boss protrudes radially outward from the curvilinear exterior surface of the bit body. Each nozzle boss is generally cylindrical and spaced between two of the bit legs. Furthermore, each nozzle boss may be inclined generally at the same angle of inclination as the lower portion of the bit leg. This inclination results in an inclined flow channel between the nozzle boss and the leading edge of the inclined lower portion of the bit leg. There is also an inclined flow channel between the nozzle boss and the trailing edge of the adjacent bit leg.

BEST MODE FOR CARRYING OUT THE INVENTION

Figure 1:
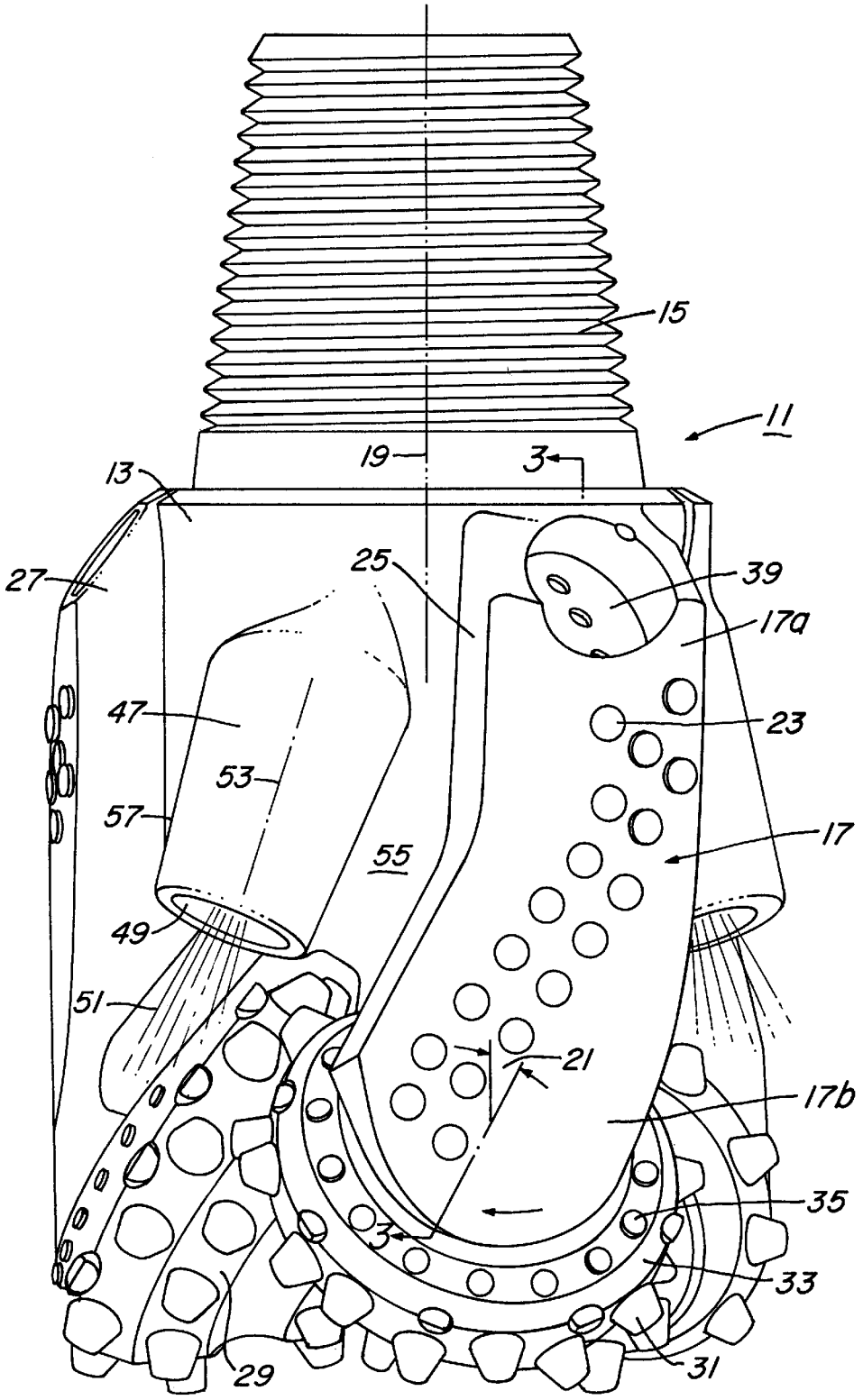
FIG. 1 is a side elevational view of an earth-boring bit constructed in accordance with this invention.

Referring to FIG. 1, bit 11 has a body 13 that is made up of three segments which are welded together. Body 13 has a curvilinear exterior surface that is generally cylindrical. A threaded pin 15 extends upward from body 13 for securing to a drill string. Body 13 has three bit legs 17 spaced symmetrically about it. Each bit leg 17 has an upper portion 17*a* which protrudes radially from the curvilinear exterior surface of body 13. Upper portion 17*a* begins approximately at the base of threaded pin 15 and extends downward to a point above the lower end of body 13. A lower portion 17*b* joins upper portion 17*a* and extends below body 13. The centerline of upper portion 17*a* is parallel with the bit axis 19. The centerline of lower portion 17*b*, however, is inclined at an angle 21 relative to upper portion 17*a*, providing a dog-leg configuration. The inclination is in the direction of rotation of bit 11 and is approximately 30 degrees relative to vertical in the embodiment shown. This places the lower end of lower portion 17*b* in a position leading the upper portion 17*a*.

A plurality of wear-resistant inserts 23 are located on bit leg 17, both in the upper portion 17*a* and lower portion 17*b*. Inserts 23 have generally flat, smooth, low friction exposed surfaces and are located in a generally inclined pattern. Alternately, inserts 23 may be domed or have rounded crests. Each bit leg 17 has a leading edge 25 and a trailing edge 27. Leading and trailing edges 25, 27 extend generally radially outward from the exterior surface of body 13. Leading and trailing edges 25, 27 are generally parallel, resulting in a circumferential width for each bit leg 17 that is approximately constant from top to bottom. Leading edges 25 and trailing edges 27 have upper portions which are oriented parallel to bit axis 19, and lower portions which are inclined at an angle approximately the same as angle 21. Inserts 23 are closer to leading edge 25 than trailing edge 27 in lower portion 17*b*. In upper portion 17*a*, some of the inserts 23 are closer to trailing edge 27 than leading edge 25 for providing stabilization. Some inserts 23 or hardfacing could also be located adjacent to the leading edge 25 for wear resistance. Bit leg upper portion 17*a* has a center point 28*a* midway between leading and trailing edges 25, 27 and located at the upper end of bit leg upper portion 17*a*. Similarly, bit leg lower portion 17*b* has a center point 28*b* midway between leading and trailing edges 25, 27 and located at the lower end obit leg lower portion 17*b*. Center point 28*b* is circumferentially offset from and leads center point 28*a*, considering the direction of rotation of bit 11.

A cutter 29 is rotatably mounted to each bit leg 17. Cutter 29 is generally conical and has a plurality of cutting elements 31 for disintegrating the earth formation. In the embodiment shown, cutting elements 31 comprise tungsten carbide inserts pressed interferingly into mating holes in the body of cutter 29. Alternately, cutter 29 could have teeth machined in the body of cutter 29. Each cutter 29 has a gage surface 33 and a heel row of cutting elements 31 adjacent to gage surface 33. When cutter 29 is rotated, the tips of the heel row cutting elements 31 will pass through a point approximately at the gage diameter of the borehole.

Figure 3:
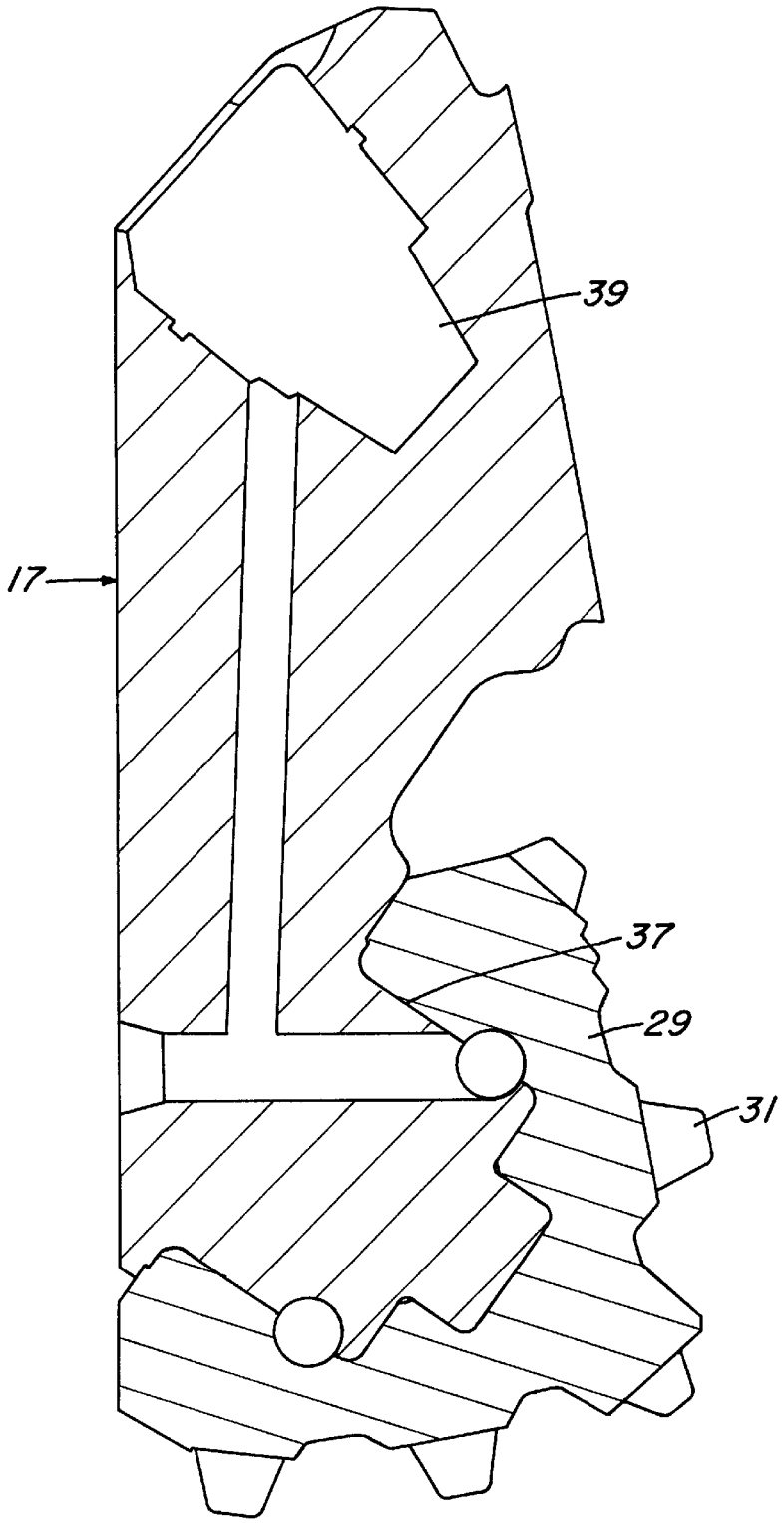
FIG. 3 is a sectional view of one of the bit legs of the bit of FIG. 1, taken generally along the line 3—3 of FIG. 1.

Referring to FIG. 3, each cutter 29 is mounted rotatably on a bearing pin 37 which is integrally formed on the lower end of each bit leg 17. A lubricant reservoir 39, shown schematically, contains lubricant which is supplied through passages to the bearing surfaces on bearing pin 37.

Figure 2:
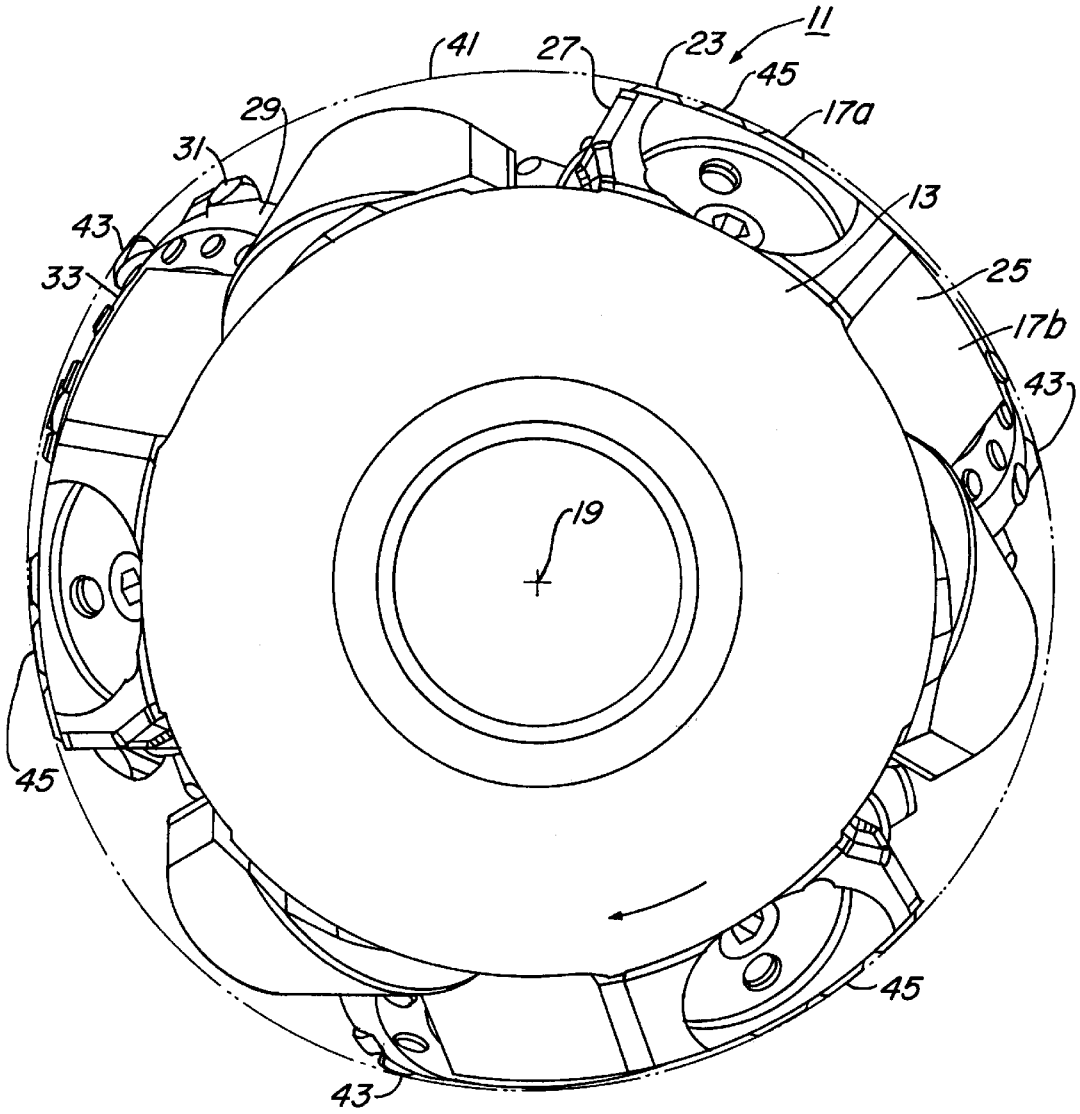
FIG. 2 is a top plan view of the bit of FIG. 1.

Referring to FIG. 2, dotted circular line 41 represents the borehole sidewall being drilled by bit 11. Because the axis of each cutter 29 is usually skewed, not on a radial line emanating from bit axis 19, generally only a single point 43 on each cutter heel row of inserts 31 will contact the borehole sidewall 41 as cutter 29 rotates. Contact point 43 is on a leading portion of each cutter 29 when skew is used. The upper portion 17*a* of each bit leg is dimensioned so that at least one of its wear-resistant inserts 23 is slightly under gage diameter so that it will contact borehole sidewall 41 to provide lateral stability. The centerline 45 of the pattern of wear resistant inserts 23 which contact borehole sidewall 41 is referred to herein as a bit leg contact point 45. Each bit leg contact point 45 is below lubricant compensator 39 and located slightly in a trailing direction from a midpoint between leading and trailing edges 25, 27 at the upper end of each bit leg 17. Bit leg contact point 45 for each bit leg 17 is 50–70 degrees circumferentially from the cutter contact point 43 of the same bit leg. Each bit leg contact point 45 is approximately diametrically opposed to one of the cutter contact points 43 of another bit leg, as shown in FIG. 2. Contact points 43, 45 result in six circumferentially or rotationally spaced contact points, each approximately 50–70 degrees apart from another.

Referring again to FIG. 1, a nozzle boss 47 is located between each of the bit legs 17. Nozzle boss 47 is a generally cylindrical member which is integrally formed with and protrudes radially from the curvilinear exterior of bit body 13. Each nozzle boss 47 houses a nozzle 49 which discharges a jet 51 of drilling fluid. Each nozzle boss 47 is inclined relative to bit axis 19. The axis 53 of each nozzle boss 47 is inclined approximately at the same angle as angle 21 in the embodiment shown, however the angle could differ. Each nozzle boss 47 is preferably spaced from both adjacent bit legs 17, creating flow channels 55, 57 on both sides of each nozzle boss 47. Flow channel 55 locates between bit leg leading edge 25 and nozzle boss 47. Flow channel 55 has a lower portion that is generally parallel with nozzle boss 47 and the lower portion of leading edge 25. This lower portion of flow channel 55 is of substantially uniform cross-section. Flow channel 55 has an upper section that is parallel with the upper portion of leading edge 25. The upper portion has slightly less width than the lower portion. However, there is no significant reduction in flow area when proceeding from the lower portion to the upper portion of flow channel 55. Flow channel 57 is also inclined similar to flow channel 55 as it is bounded by the contours of nozzle boss 47 on one side and trailing edge 27 of the adjacent leg on the other side.

In operation, threaded pin 15 is secured to the lower end of the drill string, which may include a drill motor. Drill bit 11 is rotated clockwise as seen from above in FIG. 2. This results in the cutter 29 for each bit leg 17 leading the bit leg upper portion 17*a*. Bit 11 is stabilized against lateral vibration by cutter contact points 43 and bit leg contact points 45 as shown in FIG. 2. Drilling fluid is pumped down the drill string and discharged out nozzles 49. The drilling fluid jet 51 discharges from each nozzle 49 toward the trailing edge of the leading adjacent cutter 29. The drilling fluid returns back flow channels 55, 57 on both sides of each nozzle boss 47.

The invention has significant advantages. The inclined lower leg portions result in six circumferentially spaced contact points to enhance stability of the bit. By inclining the nozzles and providing flow channels on the sides of the nozzle bosses, return flow area is more than adequate.

While the invention has been shown in only one of its forms, it should be apparent to those skilled in the art that it is not so limited but is susceptible to various changes without departing from the scope of the invention. For example, although the upper portion of each bit leg is shown oriented axially, it too could be inclined in the same manner as the lower portion of each bit leg.

We claim:

1. An earth boring bit, comprising:

a body having a longitudinal axis and a curvilinear exterior surface;

a threaded pin on an upper end of the body for connection to a drill string;

a plurality of bit legs formed symmetrically on the exterior surface of the body, each of the bit legs having an upper portion protruding from the exterior surface of the body and a lower portion extending below the body, a center point of and at the bottom of the lower portion of each of the bit legs being offset circumferentially from a center point of and at the top of the upper portion of each of the bit legs;

a cutter mounted to the lower portion of each of the bit legs for rotation about a cutter axis; and a plurality of nozzle bosses formed on and protruding from the exterior surface of the body, each of the nozzle bosses housing a nozzle for discharging drilling fluid, each of the nozzle bosses being spaced between two of the bit legs, defining at least one drilling fluid return passage on the exterior surface of the body between each of the nozzle bosses and at least one of the bit legs.

2. The bit according to claim 1, wherein the center point of the lower portion of each of the bit legs leads the center point of the upper portion of each of the bit legs, relative to a direction of rotation of the body.

3. The bit according to claim 1, wherein a centerline of the lower portion of each of the bit legs is inclined relative to the longitudinal axis of the body.

4. The bit according to claim 1, wherein the upper portion of each of the bit legs extends downward generally parallel with the longitudinal axis, and a centerline of the lower portion of each of the bit legs is inclined relative to the upper portion and leads the upper portion relative to a direction of rotation of the body.

5. The bit according to claim 1, further comprising a wear-resistant member located on the upper portion of each of thr bit legs for providing stabilization for the bit.

6. The bit according to claim 1, wherein a centerline of the lower portion of each of the bit legs is inclined relative to the longitudinal axis, and each of the nozzle bosses is inclined relative to the longitudinal axis.

7. The bit according to claim 6, wherein the centerline of the lower portions of each of the bit legs and the nozzle bosses are inclined in a leading direction relative to a direction of rotation of the bit.

8. The bit according to claim 1, wherein a centerline of the lower portion of each of the bits legs and a lower portion of the flow channels are inclined relative to the longitudinal axis.

9. An earth boring bit, comprising:

a body having a longitudinal axis and a curvilinear exterior surface;

a threaded pin on an upper end of the body for connection to a drill string;

a plurality of bit legs formed symmetrically on the exterior surface of the body, each of the bit legs having an upper portion protruding from the exterior surface of the body and a lower portion extending below the body, the lower portion of each of the bit legs being offset circumferentially from the upper portion of each of the bit legs;

a cutter mounted to the lower portion of each of the bit legs for rotation about a cutter axis;

a plurality of nozzle bosses formed on and protruding from the exterior surface of the body, each of the nozzle bosses housing a nozzle for discharging drilling fluid, each of the nozzle bosses being spaced between two of the bit legs, defining at least one drilling fluid return passage on the exterior surface of the body between each of the nozzle bosses and at least one of the bit legs; wherein each of the bit legs has a leading edge considering a direction of rotation of the bit, and wherein a lower portion of each of the leading edges is inclined relative to the longitudinal axis; and the flow channel for each of the nozzle bosses is located between each of the nozzle bosses and the leading edge of one of the bit legs, the flow channel having a lower portion that is inclined relative to the longitudinal axis substantially the same angle as the lower portion of each of the leading edges.

10. An earth boring bit, comprising:

a body having a longitudinal axis and a curvilinear exterior surface;

a threaded pin on an upper end of the body for connection to a drill string;

a plurality of bit legs formed symmetrically on the exterior surface of the body, each of the bit legs having an upper portion protruding from the exterior surface of the body and a lower portion extending below the body, the lower portion having a leading edge which is at an inclined angle relative to the longitudinal axis;

a cutter mounted to the lower portion of each of the bit legs for rotation about a cutter axis, each of the cutters providing a cutter stabilizing point that is adapted to contact a borehole sidewall;

the upper portion of each of the bit legs having leading and trailing edges and a centerline located therebetween, the centerline of the upper portion of each of the bit legs being offset circumferentially from each of the cutter stabilizing points;

a plurality of wear resistant elements mounted to the upper portion of each of the bit legs for providing bit leg stabilizing points that are offset circumferentially from the cutter stabilizing points;

a plurality of nozzle bosses formed on and protruding from the exterior surface of the body, each of the nozzle bosses housing a nozzle for discharging drilling fluid, each of the nozzle bosses being located between two of the bit legs, and wherein each of the nozzle bosses is inclined relative to the longitudinal axis in a leading direction relative to a direction of rotation of the body; and an inclined flow channel located between each of the nozzle bosses and the leading edge of the lower portion of each of the bit legs for discharging drilling fluid into the leading direction.

11. The bit according to claim 10, wherein each of the cutters has a base with a center point that leads the centerline of the upper portion of each of the bit legs, relative to the direction of rotation of the body.

12. The bit according to claim 10, wherein each of the bit legs has a trailing edge relative to the direction of rotation of the bit which has a lower portion that is inclined relative to the longitudinal axis of the bit in the same direction as the leading edge of the lower portion.

13. The bit according to claim 10, wherein the centerline of the upper portion of each of the bit legs extends downward generally parallel with the longitudinal axis.

14. The bit according to claim 10, wherein the nozzle bosses are inclined so as to discharge a jet of the drilling fluid for contact at a point closer to the cutter adjacent a leading side of each of the nozzle bosses than the cutter adjacent a trailing side of each of the nozzle bosses.

15. An earth boring bit, comprising:

a body having a longitudinal axis and an exterior surface;

a threaded pin on an upper end of the body for connection to a drill string;

a plurality of bit legs formed symmetrically on the exterior surface of the body, each of the bit legs having an upper portion protruding from the exterior surface of the body and a lower portion extending below the body, each of the bit legs having a generally dog-leg configuration, placing a lower end of each of the bit legs in a leading position relative to the upper portion;

a plurality of wear resistant elements on the upper portion of each of the bit legs, at least one of which is positioned to provide stabilization for the bit;

a cutter mounted on the lower portion of each of the bit legs for rotation about a cutter axis; and a plurality of nozzle bosses formed on and protruding from the exterior surface of the body, each of the nozzle bosses housing a nozzle for discharging drilling fluid, each of the nozzle bosses being located between two of the bit legs and being inclined relative to the longitudinal axis so as to define a return flow channel located between each of the nozzle bosses and one of the bit legs, the return flow channel having a lower portion that is inclined relative to the longitudinal axis in a leading direction.

16. The bit according to claim 15, wherein the upper portion of each of the bit legs extends generally parallel with the longitudinal axis.

17. The bit according to claim 15, wherein each of the flow channels is located between one of nozzle bosses and a leading edge of one of the bit legs.

18. The bit according to claim 15, wherein each of the bit legs has leading and trailing edges that are generally parallel to each other.

19. The bit according to claim 15, further comprising an additional return flow channel located on an opposite side of each of the nozzle bosses from said first mentioned return flow channel.

* * * * *